United States Patent [19]

Frydenlund

[11] 3,967,609

[45] July 6, 1976

[54] COMPOUND BOW

[76] Inventor: Arthur J. Frydenlund, 533 N. Marquette Road, Prairie du Chien, Wis. 53821

[22] Filed: Apr. 10, 1975

[21] Appl. No.: 566,724

[52] U.S. Cl. ..... 124/24 R; 124/90

[51] Int. Cl.[2] ..... F41B 5/00

[58] Field of Search ..... 124/24 R, 30 R, 24 A, 124/23 A, 23 R, 30 A

[56] References Cited

UNITED STATES PATENTS

| | | | |
|---|---|---|---|
| 3,812,835 | 6/1974 | Smith | 124/24 R |
| 3,841,295 | 10/1974 | Hunter | 124/24 R |
| 3,854,467 | 12/1974 | Hofmeister | 124/24 R |

*Primary Examiner*—Richard C. Pinkham
*Assistant Examiner*—William R. Browne
*Attorney, Agent, or Firm*—Andrus, Sceales, Starke & Sawall

[57] ABSTRACT

A compound type archer's bow is provided with a concentric sheave at each of the bow limb tips, and a pivotable lever with a pulley is mounted at each end of the bow handle. The levers are connected via a continuous stretch reeved over each lever and extending to the most remote sheaves on the bow limbs and then to the ends of the bowstring. A tensioning cable of fixed length is connected between each lever and its respective nearby or adjacent sheave. As the bowstring is drawn the draw force will vary due to the pivoting of the levers. When the levers pass over dead center the tension cable will engage a member on each lever and limit the maximum draw of the bowstring.

7 Claims, 8 Drawing Figures

Fig. 3
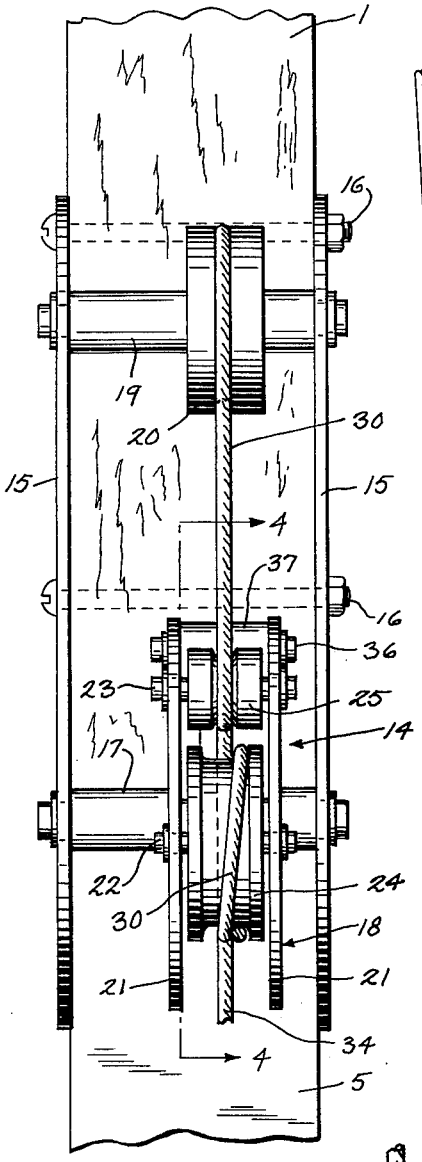
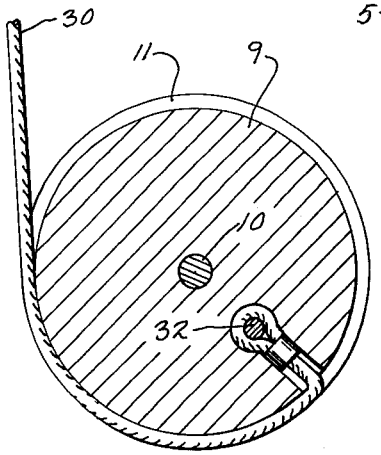
Fig. 7
Fig. 6
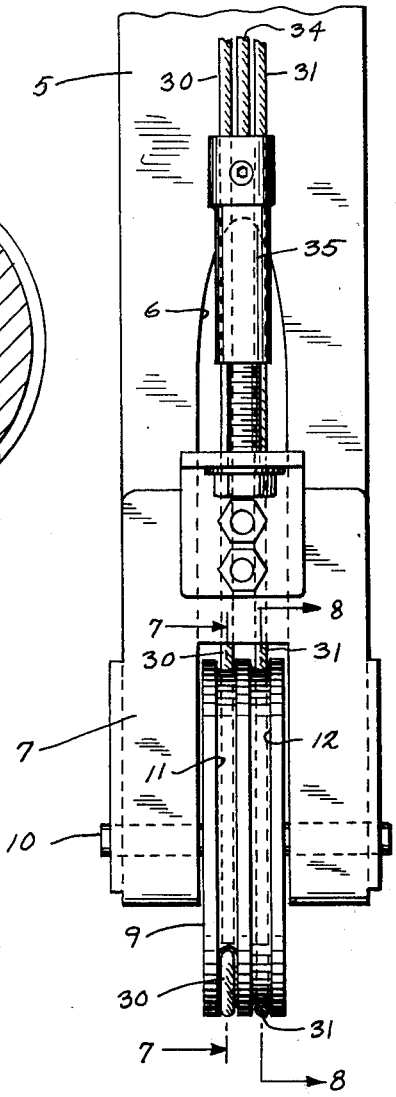
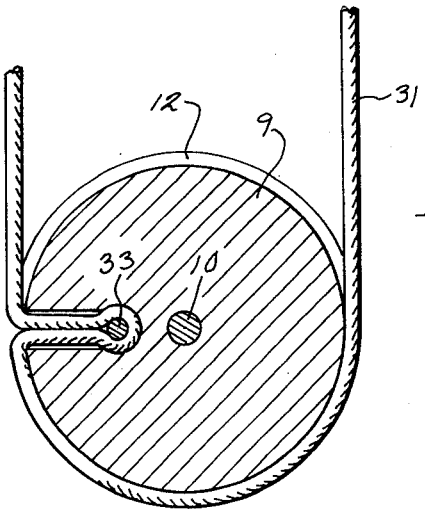
Fig. 8

COMPOUND BOW

PRIOR ART OF INTEREST

Allen U.S. Pat. No. 3,486,495 dated Dec. 30, 1969. Hofmeister U.S. Pat. No. 3,854,467 dated Dec. 17, 1974.

BACKGROUND AND SUMMARY OF THE INVENTION

This invention relates to an archery bow of the now popular compound type, such as those disclosed in the above-identified patents. By using over-center eccentric structure, the devices of these patents provide a maximum draw force at an intermediate bowstring position.

The present invention is based on the discovery that the use of eccentric sheaves and the like can be eliminated while still providing the desired variable bowstring force action.

Broadly in accordance with the invention, a concentric sheave is provided at each of the bow limb tips, and a pivotable lever is mounted at each end of the handle. Each lever is connected via cable between the opposite or remote end sheave and its adjacent bowstring end, and the nearby end sheave, where the cable is anchored. Furthermore, a tensioning cable of fixed length is connected between each lever and its respective nearby or adjacent bow limb tip. Where the bowstring is drawn, the levers will be pivoted to an over-center position and the tensioning cable will cooperate with the lever assembly to provide a variable drawing force and a positive mechanical stop for the drawing action.

BRIEF DESCRIPTION OF THE DRAWINGS

The accompanying drawings illustrate the best mode presently contemplated by the inventor for carrying out the invention.

In the drawings

FIG. 3 is an enlarged rear side elevation of the lower lever assembly taken on line 3—3 of FIG. 1;

FIG. 6 is a rear side elevation of the lower limb tip area and taken on line 6—6 of FIG. 1;

FIG. 7 is a first section through the lower limb tip sheave taken on line 7—7 of FIG. 6; and FIG. 8 is a second section through the lower limb tip sheave taken on line 8—8 of FIG. 6.

DESCRIPTION OF THE PREFERRED EMBODIMENT

Figure 1:
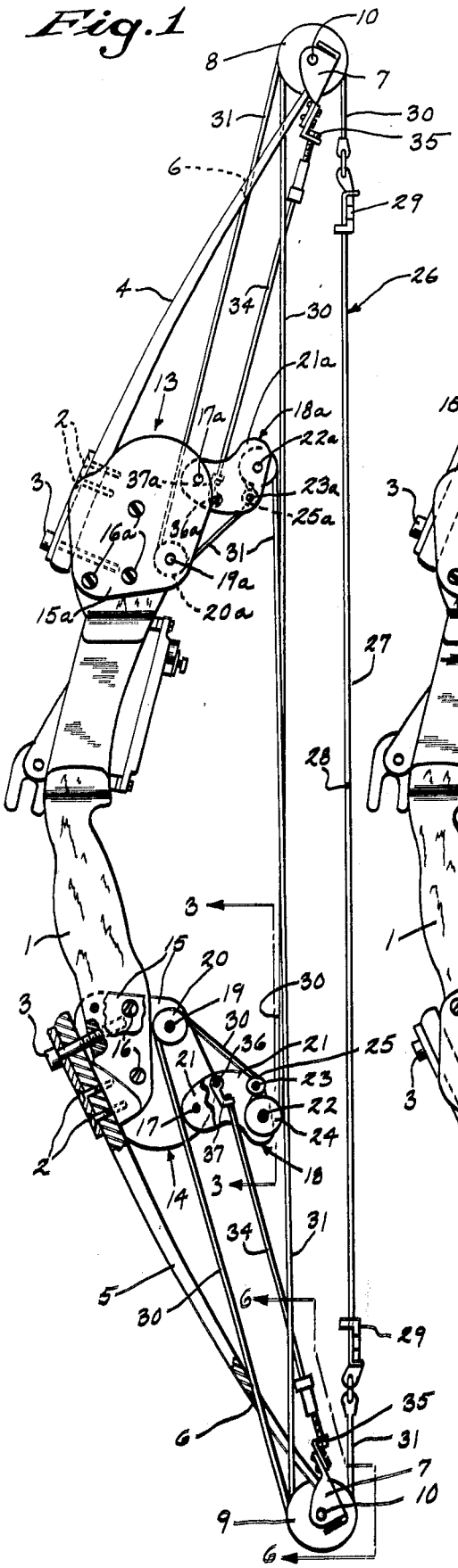
FIG. 1 is a side elevation of the compound bow of the invention, with parts broken away and in section, and with the bow in normal undrawn condition.

As shown in FIG. 1 of the drawings, the archer's bow incorporating the present invention is of the compound type and includes an elongated central handle 1 of any suitable well-known type to which is attached, as by screws 2 and adjustment bolts 3, upper and lower elongated flexible resilient limbs 4 and 5 respectively.

Referring to FIGS. 1 and 6, the outer ends of the limbs are slotted longitudinally, as at 6, and are provided with slotted brackets 7 to which are mounted, at each limb tip, a concentric sheave 8, 9 respectively. Each sheave is rotatably mounted on a transverse shaft 10 extending through the bracket. The sheaves are each provided with a pair of parallel grooved tracks 11 and 12 for purposes to be described.

In accordance with the present embodiment, upper and lower lever assemblies 13 and 14 are attached to the respective upper and lower end portions of handle 1, adjacent the handle-limb juncture. Since both assemblies are substantially identical, except for reversal of orientation, only lower assembly 14 will be specifically described. The same reference numerals are applied in the drawing to upper assembly 13, with the addition of the sub-letter *a*.

Figure 2:
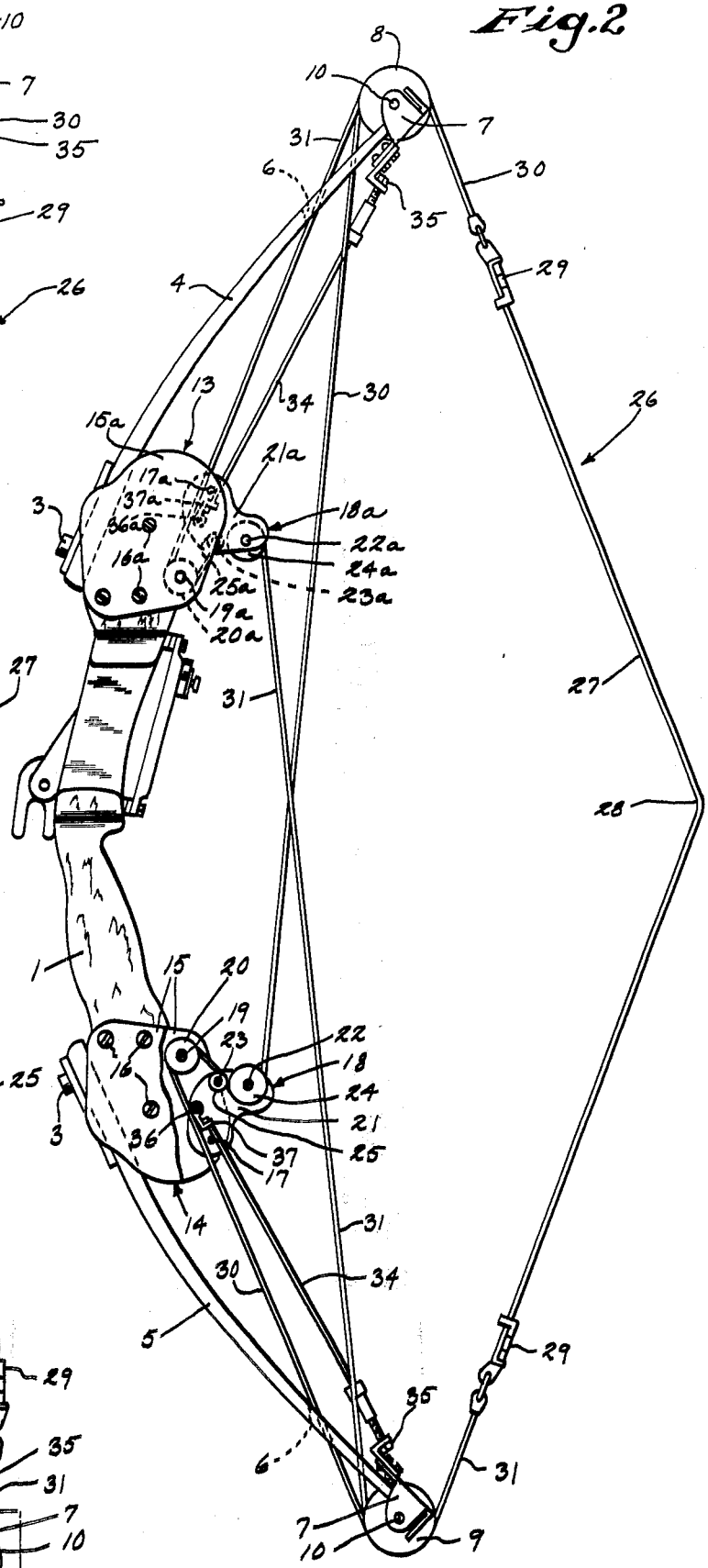
FIG. 2 is a view similar to FIG. 1 and with the bow in maximum draw position.

Referrring to FIGS. 1–3, a pair of spaced side mounting plates 15 are attached to handle 1, as by bolts 16. Plates 15 extend rearwardly and downwardly beyond the handle. The lower end portions of mounting plates 15 mount a fixed transverse shaft 17 to which is pivotally mounted the forward inner end portion of a compound lever arm 18. A second shaft 19 is disposed inwardly upwardly and slightly forwardly of shaft 17, between plates 15, and carries a rotatable force balancing pulley 20.

Compound lever arm 18 is generally L-shaped and comprises a pair of spaced plates 21. Lower and upper shafts 22, 23 extend between plates 21 along the rearward edges thereof when the lever is in normal position, i.e. when the bow is not in use. Shaft 22 carries a relatively large pulley 24, while shaft 23 carries a smaller sized pulley 25, with the pulleys being closely adjacent.

The bow is provided with a bowstring 26 having a central stretch 27 provided with a nocking point 28. Stretch 27 is connected via suitable adjustable couplings 29 at its upper and lower ends to respective end cable stretches 30 and 31.

Referring to FIGS. 1–7, stretch 30 is trained about upper sheave 8, is anchored therein as by a cotter pin (not shown) to prevent slippage, and continues longitudinally across the bow to lower lever assembly 14, which is remote from upper limb 4. At assembly 14, stretch 30 wraps around and forwardly under pulley 24, crosses rearwardly and over pulley 25, crosses to pulley 20 where it wraps around, and then extends downwardly to lower sheave 9 where it makes a partial wrap in left track 11 and then the terminus thereof is anchored to the sheave, as by a cotter pin 32 (FIG. 7).

Likewise, stretch 31 is trained about lower sheave 9, in right track 12, is anchored therein as by a cotter pin 33 (FIG. 8) to prevent slippage, and continues on to remote upper lever assembly 13 and sheave 8, in a manner similar to stretch 30.

The construction places each lever assembly so it is connected via the cable stretch between its adjacent limb end sheave and the remote end sheave and its adjacent coupling with bowstring central stretch 27.

The structure of the invention provides a variable draw force using over center leverage, as well as a positive mechanical stop for maximum draw. For this purpose, a tensioning cable 34 of fixed length extends between a bracket 35 fixed to each limb tip portion and the adjacent lever arm 18. Referring to lower assembly 14 and FIGS. 1–6, an anchoring shaft 36 extends between lever plates 21 and is disposed rearwardly and upwardly or inwardly from lever pivot shaft 17. A bracket 37 is mounted to shaft 36 and fixedly secures the upper inner end of tensioning cable 34. Cable 34 thus crosses a transverse plane 38 containing shaft 17.

Figure 4:
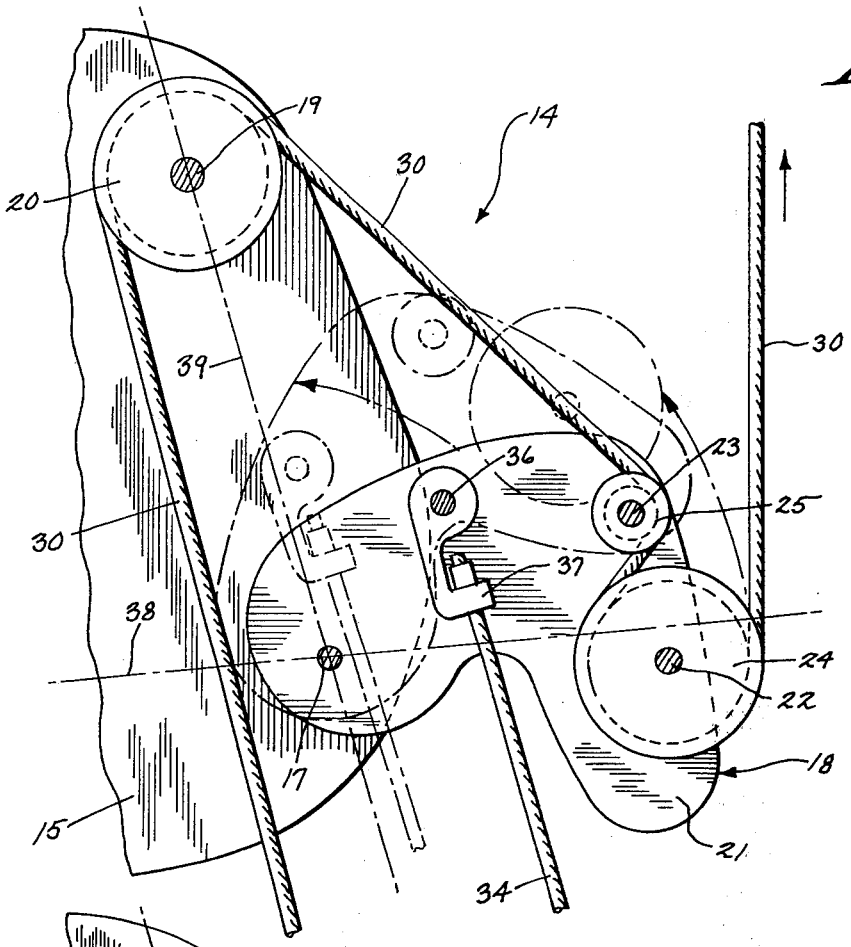
FIG. 4 is a somewhat schematic vertical section taken on line 4—4 of FIG. 3 and showing the lever arm in normal and intermediate positions.
Figure 5:
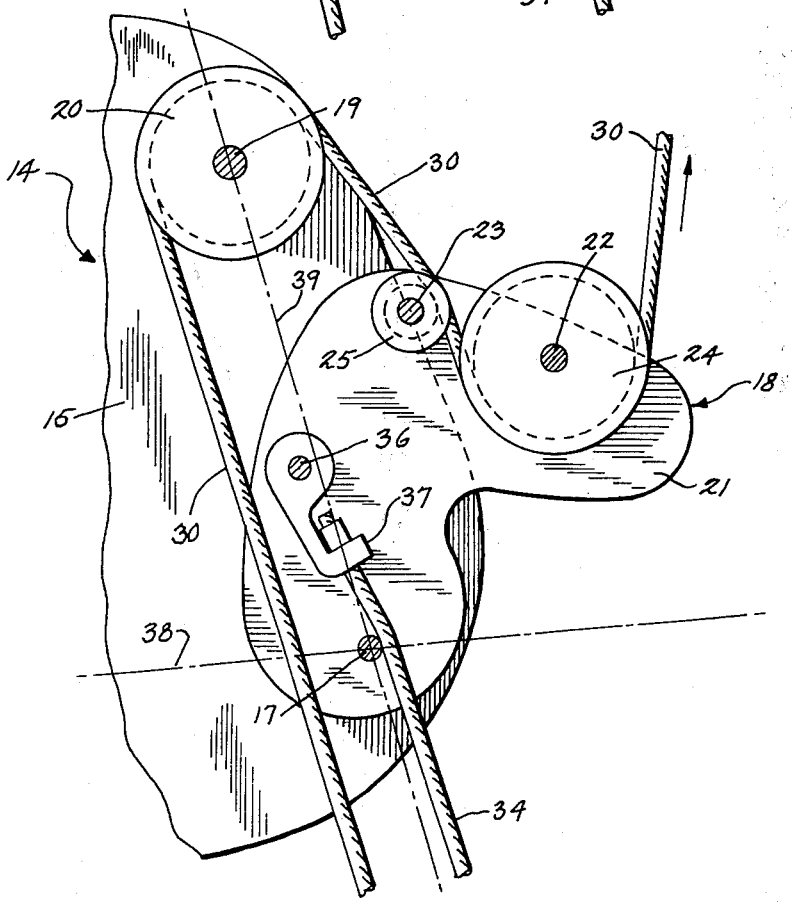
FIG. 5 is a view similar to FIG. 4 and showing the lever arm in maximum draw position.

FIGS. 4 and 5 show the lever action of the bow. In FIG. 4, the full line showing of lever arm 18 indicates the normal position. When bowstring 26 is initially drawn, arm 18 pivots upwardly and counterclockwise about shaft 17. The draw force will increase until tensioning cable shaft 36 arcuately reaches an over-center position relative to shaft 17, which is defined by plane 39 which contains shafts 17 and 19. The phantom position of lever arm 18 in FIG. 4 shows shaft 36 just before it reaches the over-center position. Further counterclockwise movement will take shaft 36 beyond plane 39, wherein the draw force will be reduced. The maximum total draw distance and lever arm pivoting is limited by a stop means comprising lever pivot shaft 17 which is engaged sideways by cable 33, as shown in FIGS. 2 and 5.

The compound bow herein disclosed provides a unique construction which enhances and improves the sport of archery.

Various modes of carrying out the invention are contemplated as being within the scope of the following claims, particularly pointing out and distinctly claiming the subject matter which is regarded as the invention.

I claim:

1. An archer's bow comprising:

a. a handle, b. a pair of limbs extending outwardly from the handle ends with said limbs having tip portions, c. a sheave mounted on each of said limb tip portions, d. a lever assembly including a lever arm mounted to said handle adjacent each said limb, e. a fixed pivot shaft on each said assembly and mounting an associated arm for pivoting therearound, f. bowstring means trained about said sheaves and said lever assemblies with drawing of said bowstring means causing said lever arms to pivot about their respective said pivot shafts when a draw force is applied, g. and means connecting each said limb tip portion with the adjacent lever arm, h. each said pivot shaft being engaged by said last-named means at maximum draw of said bowstring means to form a stop for the lever arm which mechanically limits the maximum draw distance.

2. The bow of claim 1 in which:

a. said lever assemblies are independent of each other, b. said bowstring means includes a central stretch connected at its ends to a pair of end stretches, c. and each said end stretch is trained about its adjacent sheave and crosses said bow to and through the remote said lever assembly, and passes hence to the other of said sheaves where its terminus is anchored.

3. The bow of claim 2:

a. in which each said lever arm includes a pair of pulleys over which the respective end stretch of said bowstring passes, b. and wherein each said lever assembly additionally includes a further pulley spaced inwardly from said lever arm, with the construction being such that each of said end stretches passes from its associated lever arm pulleys over said further pulley before passing to the other said sheave.

4. The bow of claim 3 in which said last-named means comprises:

a. a cable of fixed length, with one end of said cable mounted adjacent said limb tip portion and the other end thereof mounted to an anchor on said lever arm, b. each said anchor being normally disposed inwardly and rearwardly of each said pivot shaft, c. each said anchor pivoting over the dead center of each of said pivot shafts during drawing of said bowstring means to reduce the draw force.

5. The bow of claim 1 in which said last-named means comprises:

a. a cable of fixed length, with one end of said cable mounted adjacent said limb tip portion and the other end thereof mounted to an anchor on said lever arm, b. each said anchor being normally disposed inwardly and rearwardly of each said pivot shaft, c. each said anchor going over center of each said pivot shaft during drawing of said bowstring means to reduce the draw force.

6. An archer's bow comprising:

a. a handle, b. a pair of limbs connected to and extending outwardly from the handle ends with said limbs having tip portions, c. a sheave mounted on each of said limb tip portions, d. a pair of independent lever assemblies with each said assembly including a lever arm pivotally connected to said handle adjacent each connection of said limb to said handle, e. means on each said assembly mounting each said lever arm for pivotal movement, f. and bowstring means including a central stretch and a pair of end stretches said bowstring means being connected at its ends respective to one end stretch of said pair of end stretches, g. each said end stretch being trained about its most adjacent said sheave and crossing said bow and extending to and operatively connected to the most remote said lever assembly, and passing hence to the other said sheave where its terminus is anchored.

7. The bow of claim 6:

a. in which each said lever arm includes a pair of pulleys over which a respective end stretch of said bowstring means passes, b. and wherein each said lever assembly additionally includes a further pulley spaced inwardly from said lever arm, with the construction being such that each of said end stretches passes from its associated said lever arm pulleys over said further pulley before passing to the said other said sheave.

* * * * *